US005587780A

United States Patent [19]

Sugino et al.

[11] Patent Number: 5,587,780

[45] Date of Patent: Dec. 24, 1996

[54] IMAGE FORMING APPARATUS WITH DIFFERENT POTENTIALS IN DIFFERENT DEVELOPING ZONES

[75] Inventors: Osamu Sugino; Takeo Yamamoto, both of Yokohama, Japan

[73] Assignee: Canon Kabushiki Kaisha, Tokyo, Japan

[21] Appl. No.: 401,703

[22] Filed: Mar. 10, 1995

[30] Foreign Application Priority Data

Mar. 11, 1994 [JP] Japan ..... 6-041112
Mar. 1, 1995 [JP] Japan ..... 7-041814

[51] Int. Cl.[6] ..... G03G 15/16

[52] U.S. Cl. ..... 355/274; 355/245; 355/271

[58] Field of Search ..... 355/208, 245, 355/261, 265, 271, 273, 274, 276, 277

[56] References Cited

U.S. PATENT DOCUMENTS

| | | | |
|---|---|---|---|
| 4,843,423 | 6/1989 | Nakamura et al. | 355/245 |
| 5,132,738 | 7/1992 | Nakamura et al. . | |
| 5,182,604 | 1/1993 | Asai | 355/273 |
| 5,253,022 | 10/1993 | Takeuchi et al. | 355/274 |
| 5,287,149 | 2/1994 | Hoshika | 355/208 X |
| 5,337,127 | 8/1994 | Imaue | 355/271 |
| 5,410,393 | 4/1995 | Watanabe | 355/273 |

FOREIGN PATENT DOCUMENTS

| | | |
|---|---|---|
| 50-153643 | 12/1975 | Japan . |
| 51-9840 | 1/1976 | Japan . |
| 1-292385 | 11/1989 | Japan . |

*Primary Examiner*—Sandra L. Brase
*Attorney, Agent, or Firm*—Fitzpatrick, Cella, Harper & Scinto

[57] ABSTRACT

An image forming apparatus has an image bearing member; developing device for developing the image bearing member to form a toner image on the image bearing member, in a developing zone; and a transferring member for forming a nip in cooperation with the image bearing member and for transferring the toner image onto a transfer material in the nip. During a portion of a period in which the transfer material is not in the nip, an electric field is formed for transferring the toner having the same polarity as the toner image from the transferring member to a first region of the image bearing member. A discharging unit is provided for discharging a second region of the image bearing member; wherein a potential of the first region in the developing station is different from a potential of the second region in the developing zone, and a bias voltage applied to the developing unit when the first region is in the developing zone before the generation of the electric field is different from that applied when the second region having been discharged by the discharging unit is in the developing zone.

16 Claims, 2 Drawing Sheets

IMAGE FORMING APPARATUS WITH DIFFERENT POTENTIALS IN DIFFERENT DEVELOPING ZONES

FIELD OF THE INVENTION AND RELATED ART

The present invention relates to an image forming apparatus, such as an electro-photographic apparatus and or electrostatic recording apparatus, in particular, to an image forming apparatus comprising a transferring member such as a transfer roller which makes contact with the backside of transfer material.

There has been proposed an image forming apparatus comprising a rotary image bearing member and a contact type transferring member such as a transfer roller, which is rotated in synchronism with the image bearing member, being pressed thereon to form a compression nip which functions as a transfer station. In this apparatus, an image is formed of charged toner on the rotary image bearing member and is transferred onto a transfer material such as a sheet of paper being passed through the compression nip, or the transfer station, due to an electric field generated through an application of a transfer bias to the transferring member. In this case, the transfer bias has a polarity opposite to the toner image polarity.

Such a transferring means offers various advantages. For example, it more reliably holds the transfer material, and therefore, it is less likely to cause image deviation due to the image transfer in the transfer station than a conventional corona charger. Also, it requires a transfer bias of a relatively low level, which allows the apparatus to be more compact, and also prevents ozone generation. However, it also has a down side. That is, when the width of an original is wider than the transfer material, or when a thick original, a page of a thick book, or the like, is copied, the image bearing member is developed on its region beyond the width of the transfer material, and the toner from this region is adhered to the transfer roller, being sometimes scattered to soil the adjacencies of the transfer roller or the back side of the next transfer material.

Japanese Laid-Open Patent Application No. 153,643/1975, 9,840/1976 or 292,385/1989, or a U.S. Pat. No. 5,132,738, offers a proposal for avoiding such predicaments as described above, in which when the transfer material is not in the transfer station, a cleaning bias having the same polarity as the toner is applied to the transfer roller to return to the image bearing member the toner adhering to the transfer roller.

However, there is a difference in the image hearing member potential between when the image bearing member is charged to boost the cleaning performance during a cleaning operation for the transfer roller, and after the image bearing member is discharged. Therefore, the fog causing toner is deposited on the image bearing member by a developing device, subsequently soiling the transfer roller.

More specifically, the positively charged normal toner adhering to the transfer roller is effectively returned to the image bearing member by adjusting the output of charging means. In other words, when the transfer roller is cleaned while no image is formed, the output of the charging means is controlled so that the image bearing member potential remains within a range of −300 V to −400 V, provided that the image bearing member is composed of negatively chargeable organic photosensitive material. When no image is formed and the transfer roller is not cleaned, the image bearing member is discharged by the blank exposure or the like after the bias is applied by the charging means, or the charging means is deactivated; therefore, the image bearing member potential settles in an approximate range of 0 V to −50 V.

As for the developing bias applied to the developing roller as developing means during this non-image making period, since this developing bias is for preventing the image bearing member potential from being developed during the transfer roller cleaning operation, its bias level is normally kept the same as that applied to the image bearing member, that is, −300 V to −400 V.

However, during the non-cleaning period, the image bearing member potential is in the range of 0 V to −50 V, and the developing bias is, for example, in the range of −300 V to −400 V; therefore, the bias at this time is on the reversal development side. As a result, it is liable that the image bearing member is developed by the negatively charged reverse toner (toner charged to a polarity opposite to the normally charged toner) depending on the toner age and/or ambient conditions.

SUMMARY OF THE INVENTION

An object of the present invention is to provided an image forming apparatus capable of preventing the backside contamination of the transfer material.

Another object of the present invention is to provide an image forming apparatus capable of preventing the toner from being adhered to the non-imaging region of the image bearing member by the developing means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiment of the present invention will be described with reference to the drawings.

Figure 1:
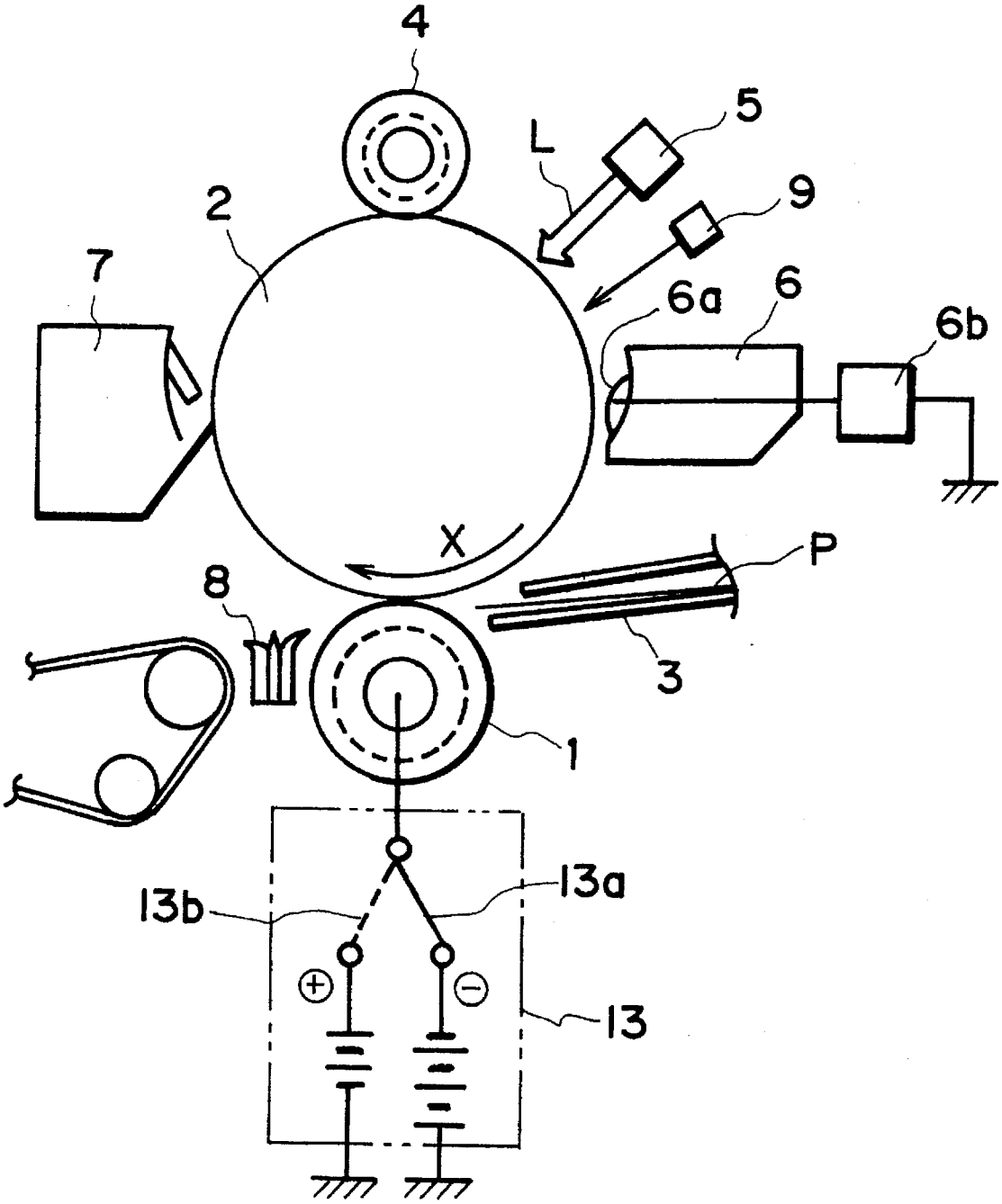
FIG. 1 is a schematic sectional view of the essential portion of an image forming apparatus in an embodiment of the present invention.

FIG. 1 is a schematic side view of the essential portion of the image forming apparatus suitable for the application of the present invention.

The image bearing member in this embodiment is a negatively chargeable, cylindrical photosensitive member 2, which rotates in the direction of an arrow X about an axis perpendicular to the surface of this page. The surface of the photosensitive member 2 is uniformly charged to −650 V by a charge roller 4 which may serve as the charging means. As this charged surface is exposed by an exposing means 5 in response to imaging information, an electrostatic latent image is formed thereon. Then, the toner charged to a polarity opposite to the charging means polarity, that is, the positively charged toner, is supplied from a developing device 6 to this electrostatic latent image, whereby the latent image is positively developed into a toner image. This positively developed toner image is delivered to a transfer station formed as the photosensitive member 2 and a transfer roller 1 come into contact with each other at a predetermined contact pressure. The developing device 6 comprises a developing sleeve *6a*, which carried developer coated thereon to a predetermined thickness. During a developing period, a voltage of −300 V is applied to the developing sleeve 61 by a power source *6b*.

Meanwhile, a transfer material P is synchronously guided into the transfer station by a transfer guide 3. In the transfer station, the transfer material is pressed on the backside by the transfer roller 1, and at the same time, a transfer bias with a polarity opposite to the normal toner polarity is applied to the transfer roller 1 by a power source 13, whereby an electrical field is generated, and the toner image is transferred onto the transfer material P by the function of this electrical field. At this moment, the switch of the power source 13 is on the solid line side *13a*. During the transferring period, a voltage of −4 kV is applied to the transfer roller.

Thereafter, the transfer material P is electrically discharged by the function of a discharging needle 8 and is sent through a designated conveyance passage to an unillustrated fixing station. Meanwhile, the residual toner, that is, the toner which did not transfer from the photosensitive member 2 to the transfer material P during the transferring period, is removed by a cleaner 7. Then, the photosensitive member 2 enters the next round of the image forming operation. Further, the photosensitive member 2 is subjected to the blank exposure by a lamp 9 on the non-imaging forming region, except for the transfer roller cleaning region (first region).

As for the transfer roller 1, that is, the contact type member in contact with the photosensitive member 2, it is supplied with a transfer bias having a polarity opposite to the normal toner polarity during the developing period, and if at this time, the toner developed region of the photosensitive member 2 is larger than the transfer material P, the toner adheres to the transfer roller 1. Therefore, a cleaning bias is applied to the transfer roller 1 by the power source 13 for at least a portion of a period, in which the transfer material is not in the transfer station, for example, a pre-rotation period of the photosensitive member 2, which occurs before the image formation occurs on the photosensitive member 2, or a period from the moment the transfer material P comes out of the transfer station till the arrival of the following transfer material P at the transfer station, while a continuous image forming operation is carried out involving a plurality of transfer materials P, that is, while copies are consecutively made. This cleaning bias has a polarity opposite to the polarity of the bias applied to the transfer roller 1 during the transferring period. In other words, it has the same polarity as the normal toner polarity during the developing period. As for the duration of the cleaning bias application to the transfer roller 1, it is preferable to be long enough so that the transfer roller 1 can rotate at least one full turn. With this cleaning bias application, the toner adhering to the transfer roller 1 is returned to the photosensitive member 2, whereby the backside contamination of the transfer material and/or scattering of the toner within the apparatus can be prevented. During the period of this cleaning bias application, the switch of the power source 13 is on the dotted line *13b* side.

In the illustrated apparatus, the surface layer of the photosensitive member 2 is OPC material chargeable to the negative polarity. Its diameter is 60 mm, and the process speed is 70 mm/sec. The transfer roller 1 is 20 mm in diameter and 230 mm in length, and comprises a metallic core and a layer of foamed EPDM (ethylene propylene dien monomer) in which carbon is dispersed, wherein when a voltage of, for example, 1 kV, is applied to this transfer roller 1, the volumetric resistivity of the foamed layer is $10^5$ Ω/cm. During the transferring period, the transfer roller 1 is under constant voltage control at a voltage level of −4 kV, and during the cleaning period, it is under constant current control at a current level of +0.5 μA (+2.5–+3.0 kV).

The charge roller 4 is 12 mm in diameter, and comprises a metallic core and a carbon dispersed EPDM layer covering the core, and its volumetric resistivity is $5\times10^5$ Ω/cm when a voltage of, for example, 1 kV, is applied to the charging roller 4.

Figure 2:
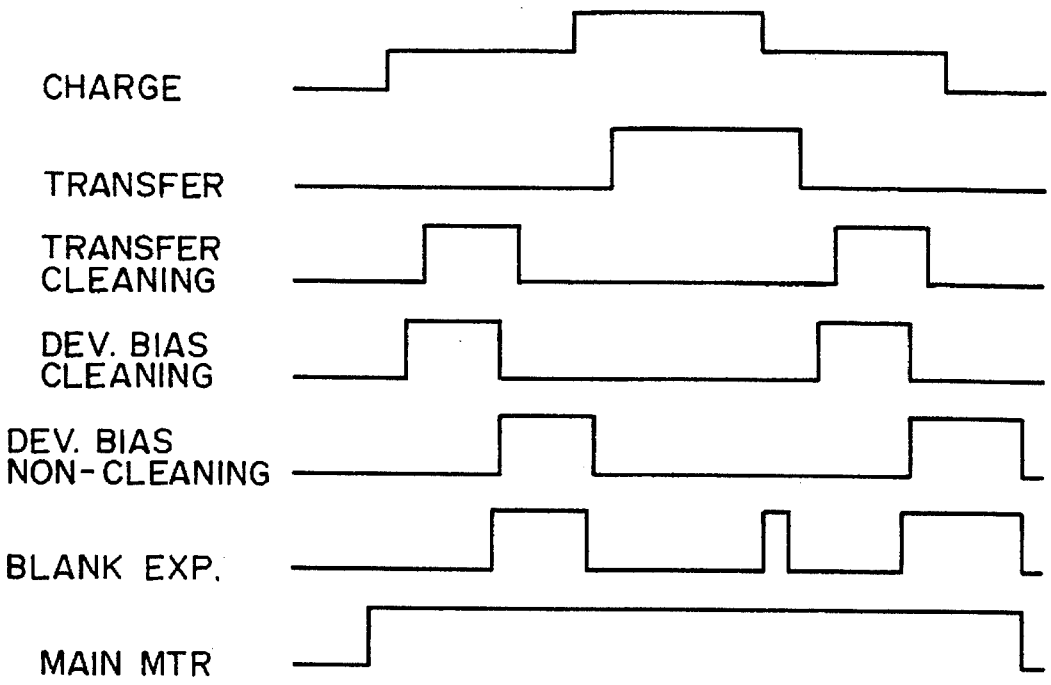
FIG. 2 is an operational sequence chart for the apparatus illustrated in FIG. 1.
Figure 3:
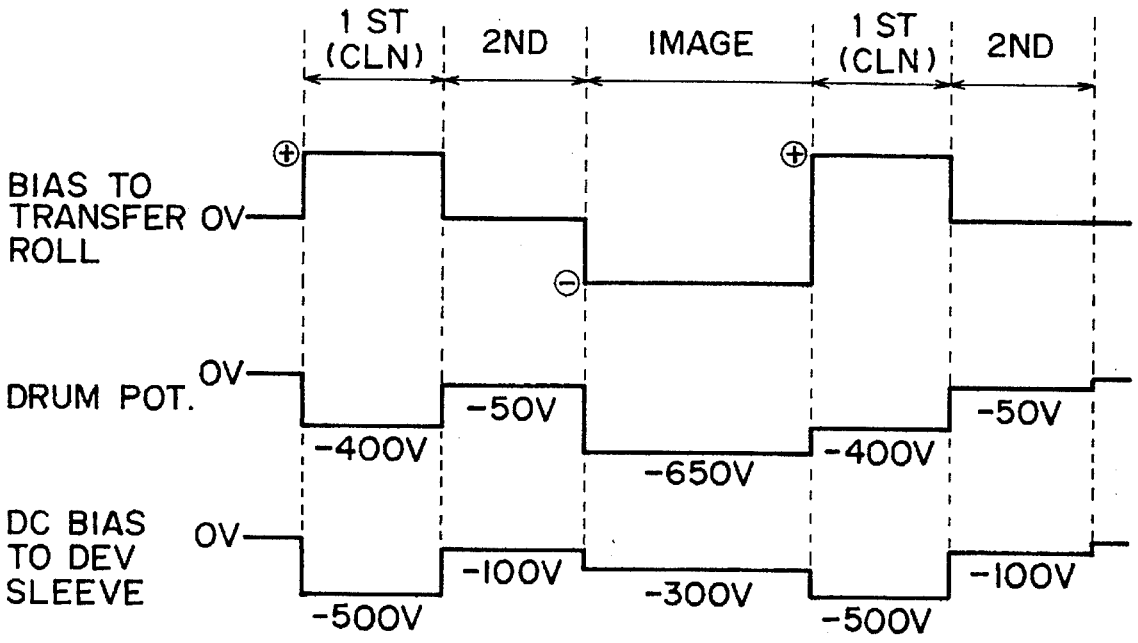
FIG. 3 is an explanatory chart depicting the relations among the photosensitive material potential, bias applied to the developing sleeve, and bias applied to the transfer roller, with reference to various regions of the photosensitive member.

FIG. 2 presents a timing sequence for the apparatus of this embodiment, and FIG. 3 shows the changes in the photosensitive member potential, developing sleeve potential, and bias applied to the transfer roller, with reference to each of the photosensitive member regions.

Assuming that a negatively chargeable OPC is used as the material for the photosensitive member, when the cleaning bias is applied to the transfer roller so that the toner is effectively transferred from the transfer roller to the first region of the photosensitive member (region that passes through the transfer station when the electric field for transferring the toner from the transfer roller to the photosensitive member is generated), the charging means is normally activated in advance to charge the first region of the photosensitive member to a potential range of substantially −300 V to −500 V (for example, −400 V). Charging the first region to the negative potential can prevent the creation of the plus memory in the first region when the cleaning bias is applied to the transfer roller). Normally, the developing sleeve *6a* is supplied with an AC (for example, Vpp: 1,300 V; frequency: 2 kHz) superposed on a DC. However, while the first region of the photosensitive member passes through the transfer station, the DC component having a voltage in a range of substantially −400 V to −600 V is applied, in addition to the AC component, to the developing sleeve *6a* in order to prevent the development of the photosensitive member. It is preferable that the absolute value of the voltage applied to the developing sleeve *6a* while the first region passes through the developing station is slightly larger than the potential of the first region, with a difference of no more than 200 V.

This is because of the following reason: when the absolute value of the voltage applied to the developing sleeve is less than that of the first region, it is easier for the positively charged normal toner to adhere to the first region, and on the other hand, when the absolute value of the voltage applied to the developing sleeve is excessively larger than that of the first region, it is easier for the negatively charged reverse toner to adhere to the first region. At this time, an electric field, which functions to move the reverse toner from the developing sleeve *6a* toward the first region, is generated, but the strength of this electric field is relatively small, and also, the amount of the reverse toner is small in comparison with the amount of the normal toner; therefore, the reverse toner adhesion to the first region rarely occurs.

On the other hand, the second region comprising: a photosensitive member region that passes through the transfer station between the moment the cleaning bias application to the transfer roller is ended and the beginning of the image transfer; and another photosensitive member region that passes through the transfer station after the image transfer and subsequent cleaning bias application to the transfer roller, is a region that does not contribute to clean the transfer roller, and is subjected in advance to the blank exposure by the lamp 9, being discharged to a potential level of substantially 0 V to −100 V, for example, −50 V. The second region may be discharged by the charge roller 4 instead of the lamp 9.

When the DC component of the bias to be applied to the developing sleeve *6a* while this discharged second region passes the developing station is set at a voltage level in a range of −300 V to −500 V, which is the same as that applied to the first region; therefore, it becomes easier for the negatively charged reverse toner to adhere to the second region than to remain on developing sleeve *6a*.

However, during the non-cleaning period, either the photosensitive member is not charged, or its potential is reduced to a range of 0 V to −100 V by the exposure when charged. Therefore, if the DC component applied to the developing means is set at the same voltage of −300 V to −500 V as it is during the cleaning period, the bias becomes reversed relative to the photosensitive member. In such a case, it is conceivable that the reverse toner, which increases on the developing sleeve *6a* when the ambient humidity is low or the developer is aged, is liable to transfer onto the photosensitive member, and recontaminates the transfer roller.

Therefore, in this embodiment, the DC component, which is applied to the developing sleeve *6a* while the second region passes the developing station, is set in a range of −100 V to −200 V, for example, −100 V. In this case, in order to prevent the positively charged normal toner and negatively charged reverse toner from adhering to the second region, it is preferable that the absolute value of the voltage, which is applied to the developing sleeve *6a* while the second region passes the developing station, is rendered slightly larger than the absolute value of the potential of the second region, with their difference in potential being no more than 250 V. Also, at this time, an electrical field, in which the reverse toner moves from the developing sleeve *6a* toward the second region, is formed. However, the strength of this electric field is relatively small, and the amount of the reverse toner is also small relative to the amount of the normal toner; therefore, it rarely happens that the reverse toner adheres to the second region.

When the second region is in the transfer station, a voltage of 0 V is applied to the transfer roller without carrying out the transfer cleaning operation. It is also acceptable to apply a negative voltage to the transfer roller while the second region is in the transfer station, but it is not acceptable to applied a positive voltage to the transfer roller at this time, since the application of the positive voltage generates a plus memory on the second region, which is difficult to eliminate by discharging.

Further, when the second region is not discharged by the lamp 9 across its portion that passes the transfer station between the time when the cleaning bias application to the transfer roller is ended and the time when the image transfer begins, the primary charge potential sometimes changes while the photosensitive member is used for an extended period. In other words, when this region is not discharged, the toner is liable to be adhered to this region by the developing sleeve *6a*. Thus, it is preferable to discharge this region so that even when the photosensitive member is used for an extended period, the potential of this region remains stable, preventing thereby the toner adhesion to the region.

FIG. 2 is an exemplary timing chart. As shown in FIG. 2, the transfer roller is cleaned twice, once before the image formation and once more thereafter, being followed by a non-cleaning rotation, wherein the DC component of the developing bias is correspondingly switched from the cleaning DC to non-cleaning DC.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

developing means for developing said image bearing member to form a Loner image on said image bearing member in a developing zone; and a transfer member for transferring at a transfer position the toner image from said image bearing member to a transfer material, said transfer member being contactable to a side of the transfer material fed between said image bearing member and said transferring member that is opposite to a side facing said image bearing member, wherein during a portion of a period in which the transfer material is not at the transfer position, an electric field is generated for transferring toner having the same polarity as the toner image from said transferring member to a first region of said image bearing member; and discharging means for discharging a second region of said image bearing member, said second region being in a non image-formation area of said image bearing member, wherein a potential of the first region in the developing zone is different from a potential of the second region in the developing zone, and a bias voltage applied to said developing means when the first region is in the developing zone before the generation of the electric field is different from that applied when the second region having been discharged by said discharging means is in the developing zone.

2. An image forming apparatus according to claim 1, further comprising charging means for charging said image bearing member to form the toner image, wherein a charge polarity of said charging means is opposite from the polarity of toner image.

3. An image forming apparatus according to claim 2, wherein the first region is charged by said charging means, and the absolute value of the potential of the first region in the developing zone is larger than that of the second region in the developing zone.

4. An image forming apparatus according to claim 3, wherein an absolute value of the bias voltage applied to said developing means is larger when the first region is in the developing zone than when the second region is in the developing zone.

5. An image forming apparatus according to claim 4, wherein when the first or second region is in the developing zone, a voltage for preventing the toner having the same charge polarity as the toner image from adhering to the first or second region is applied to said developing means.

6. An image forming apparatus according to claim 5, wherein a difference between the potential of said image bearing member and the bias voltage applied to said developing means is no more than 250 V regardless of the regions, the first or second region.

7. An image forming apparatus according to claim 2, wherein when the first or second region is in the developing zone, a voltage for preventing the toner having the same charge polarity as the toner image from adhering to the first or second region is applied to said developing means.

8. An image forming apparatus according to claim 2, wherein the first region is before the second region.

9. An image forming apparatus according to claim 2, wherein the first and second regions pass through the transfer zone after the toner image is transferred onto the transfer material.

10. An image forming apparatus according to claim 2, wherein said image bearing member comprises a photosensitive layer, and said discharging means exposes said image bearing member.

11. An image forming apparatus according to claim 2, wherein in the developing zone, an absolute value of the first region potential is smaller than an absolute value of the potential to which the said image bearing member is charged by said charging means to form the toner image.

12. An image forming apparatus according to claim 2, wherein when the electric field is formed, a voltage having the same polarity as the toner charge polarity is applied to said transferring member.

13. An image forming apparatus according to any one of claims 1–12, wherein said transferring member is a rotary member, and the electric field is formed for a duration of at least one full revolution of said transferring member.

14. An image forming apparatus according to any one of claims 1–12, wherein when the toner image is transferred onto the transfer material, a voltage having a polarity opposite to the toner charge polarity is applied to said transferring member.

15. An apparatus according to claim 1, wherein said transfer member is contactable to said image bearing member at the transfer position.

16. An apparatus according to claim 1, wherein when the first or second region is in the developing zone, a voltage for preventing the toner having the same charge polarity as the toner image from adhering to the first or second region is applied to said developing means.

* * * * *

UNITED STATES PATENT AND TRADEMARK OFFICE

CERTIFICATE OF CORRECTION

PATENT NO. : 5,587,780
DATED : December 24, 1996
INVENTOR(S) : Osamu SUGINO, et al.

It is certified that error appears in the above-indentified patent and that said Letters Patent is hereby corrected as shown below:

TITLE PAGE, Abstract, [57]:
Line 2, before "developing device", insert --a--.

COLUMN 1:
Line 9, delete "and";
Line 10, before "in", insert --and--;
Line 50, "hearing" should read --bearing--.

COLUMN 5:
Line 27, "recontaminates" should read --recontaminate--;
Line 51, "applied" should read --apply--.

COLUMN 6:
Line 16, Loner" should read --toner--;
Line 17, delete "and";
Line 47, before "toner", insert --the--.

Signed and Sealed this

Eighth Day of July, 1997

Bruce Lehman

*Attest:*

BRUCE LEHMAN

*Attesting Officer*

*Commissioner of Patents and Trademarks*